United States Patent [19]

Claudio

[11] 4,128,382

[45] Dec. 5, 1978

[54] KEYBOARD RECOCKING MECHANISM

[75] Inventor: Gillio Claudio, Brosso Canavese (Turin), Italy

[73] Assignee: Ing. C. Olivetti & C., S.p.A., Ivrea (Turin), Italy

[21] Appl. No.: 834,785

[22] Filed: Sep. 19, 1977

[30] Foreign Application Priority Data

Sep. 22, 1976 [IT] Italy ..... 69273 A/76

[51] Int. Cl.[2] ..... B41J 23/08; B41J 5/24

[52] U.S. Cl. ..... 400/478; 400/666; 400/668

[58] Field of Search ..... 197/16, 17, 18, 98, 197/107

[56] References Cited

U.S. PATENT DOCUMENTS

| | | | |
|---|---|---|---|
| 3,642,110 | 2/1972 | Hishida et al. | 197/107 |
| 3,664,478 | 5/1972 | Menicanti et al. | 197/107 |
| 3,718,243 | 2/1973 | Chvatlinsky | 197/16 |
| 3,759,360 | 9/1973 | Rix et al. | 197/16 X |
| 3,828,909 | 8/1974 | Roano et al. | 197/16 |
| 3,882,987 | 5/1975 | Link | 197/16 |
| 3,957,149 | 5/1976 | Salto | 197/16 |
| 4,027,763 | 6/1977 | Salto | 197/16 |

*Primary Examiner*—Paul T. Sewell

*Attorney, Agent, or Firm*—Schuyler, Birch, Swindler, McKie & Beckett

[57] ABSTRACT

A keyboard of a typewriter comprises a common actuator biased by a spring. The depression of a key causes a corresponding intermediate member to engage with the actuator to initiate an operating cycle and to move the intermediate member to a position which causes selection of an operation corresponding to the key which has been depressed. The engagement of the common actuator with more than one intermediate member consequent upon depression of more than one key causes the common actuator to move under the spring bias at a substantially reduced speed and a locking mechanism to lock selected operations. A reloading mechanism is responsive to the speed of the actuator for unlocking the locking mechanism and restoring the actuator and the intermediate member when the reduced speed is sensed.

13 Claims, 7 Drawing Figures

KEYBOARD RECOCKING MECHANISM

BACKGROUND OF THE INVENTION

The present invention relates to a recocking mechanism for recocking the keyboard of an electric typewriter, teleprinter, accounting machine or other office machine. Recocking refers herein to restoration of the state in which the keyboard is ready for depression of a key. Recocking takes place automatically on completion of a regular typing cycle. The present invention concerns the problem of recocking when the typing cycle has been blocked because two keys have been depressed.

In a known recocking mechanism, a typing kinematic train is activated by a clutch which is closed or engaged only when a common actuator engages a single setting element released by a key. If more setting elements than one are released simultaneously, a series of balls prevents the actuator completing its stroke and closing the clutch. In this way, the typing cycle is blocked. By then depressing a release key, a toothed lever is released and arranges itself in the path of a continuously oscillating cam-following lever. The lever is pulled by the latter and, through the medium of a connecting rod to which the lever is pivoted, recocks the common actuator in opposition to the action of a setting spring. Moreover, by means of an inverted V-element, the connecting rod restores the setting elements to their respective rest positions. This recocking mechanism is simple, can safely be relied on and prevents a setting error causing a typing error. On the other hand, it requires the operator to interrupt typing in order to actuate the release key.

SUMMARY OF THE INVENTION

The object of the present invention is to enable the recocking action to take place, when two keys have been depressed simultaneously, without any intervention from the operator.

According to the present invention there is provided a keyboard recocking mechanism in a keyboard wherein depression of a key causes a corresponding intermediate member to engage with a common, spring-biased, oscillating actuator arranged to initiate an operating cycle and to move the intermediate member to a position which causes selection of an operation corresponding to the key which has been depressed, wherein engagement of the actuator with more than one intermediate member consequent upon depression of more than one key causes the actuator to move under the spring bias at a substantially reduced speed, the recocking mechanism comprising a sensor responsive to the speed of the actuator and a reloading mechanism controlled by the sensor and arranged, when the substantially reduced speed is sensed, to restore the actuator and engaged intermediate members to recocked positions ready for initiation of an operating cycle by depression of a key.

BRIEF DESCRIPTION OF THE DRAWING

The invention will be described in more detail, by way of example, with reference to the accompanying drawing, wherein.

DESCRIPTION OF THE PREFERRED EMBODIMENT

The recocking mechanism is incorporated in a keyboard for an electric typewriter substantially similar to that described in the specification of the U.S. Pat. No. 4,027,763 which is incorporated herein as reference and which will be described only briefly here.

Figure 1:
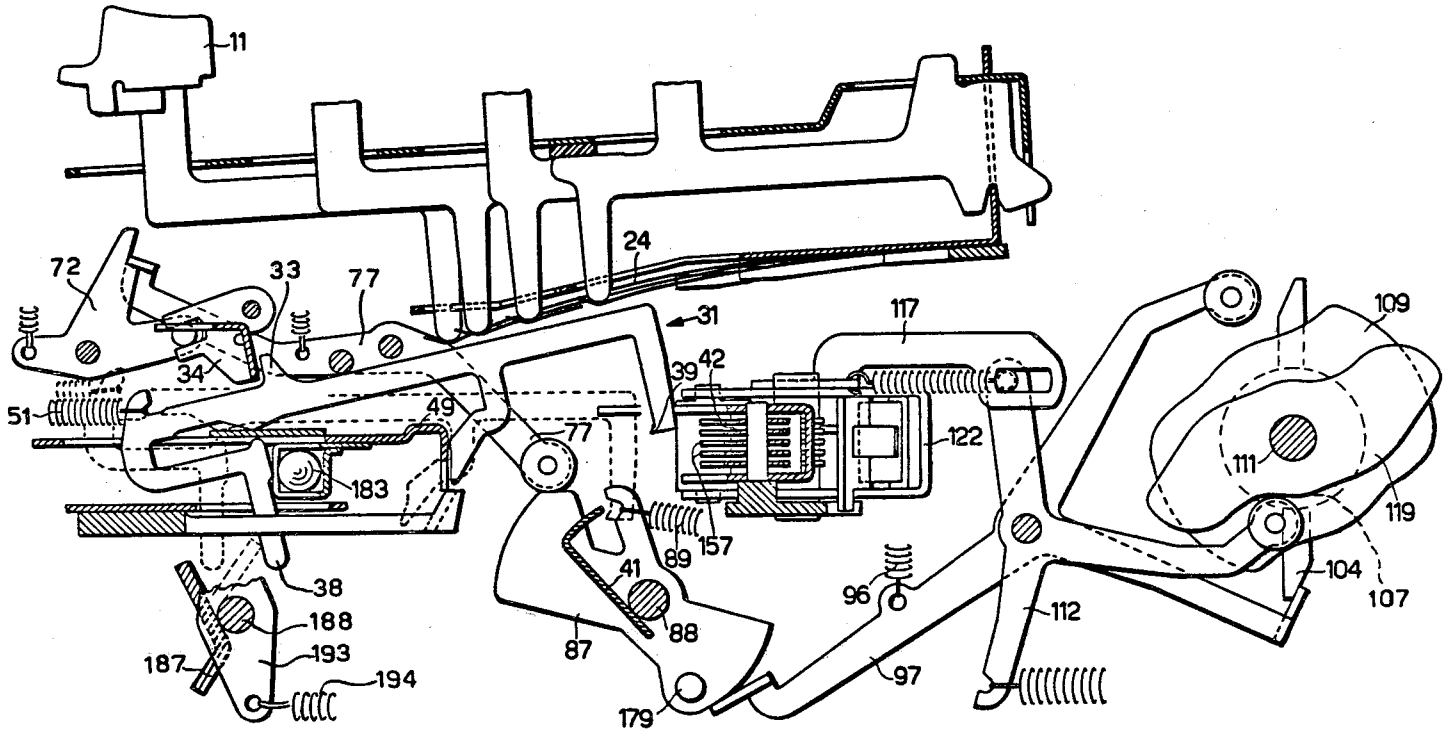
FIG. 1 is a partial longitudinal view of a keyboard for an electric typewriter.

Referring to FIG. 1, on depression of a typing key 11, a corresponding setting element 31 is released from a guide plate 49 by a leaf spring 24, the element 31 being brought into the position shown in dash lines by a spring 51. During this movement, a tooth 33 of the setting element 31 releases, through the medium of a universal bar 34 and levers 72 and 77, a common actuator or universal bar in the form of a bent plate 41 fast with a shaft 88. Under the action of a setting spring 89, the bar 41 engages a tooth 39 of the released setting element 31 and moves this back (to the right in FIG. 1) into the path of teeth 157 of code bars 42. With the universal bent plate 41 there also rotates a cam 87 fixed to the shaft 88 and with which a lever 97 co-operates under the action of a spring 96. When the cam 87 presents a steep profile thereof, it releases the lever 97 (FIG. 1) which, under the action of the spring 96, releases a stop 104 of a clutch 107, starting a typing cycle of the machine, while the universal bent plate 41 rotates clockwise until a pin 179 on the cam 87 (FIG. 3) is arrested against the far end of a slot 178 of a tie rod 176.

Figure 6:
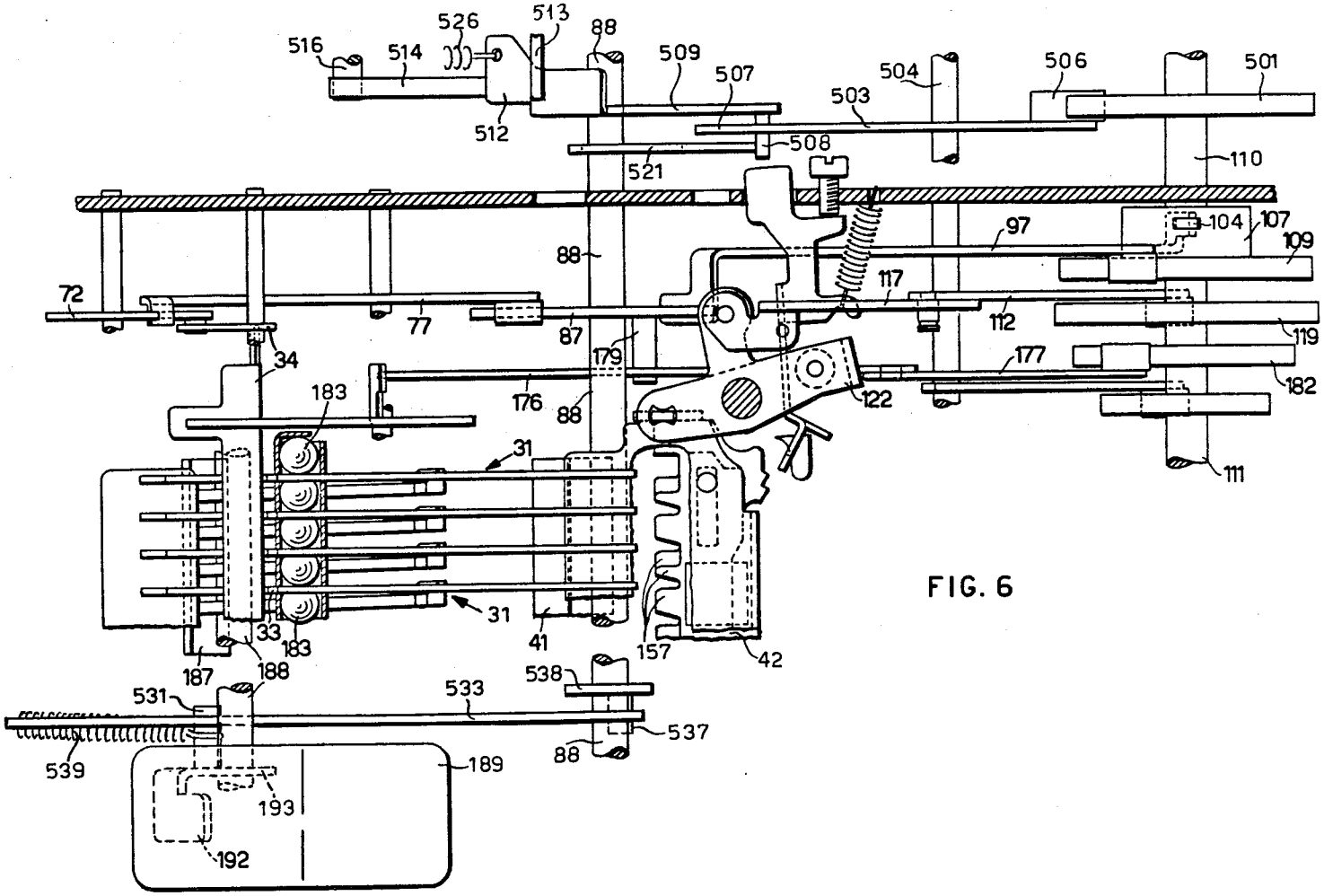
FIG. 6 is a partial plan view of the keyboard of FIG. 1 and of the mechanism of FIG. 2.

The clutch 107 comprises a driving part fast with a driving shaft 110 (FIG. 6) rotating continuously in a manner known per se, and a driven part fixed to a shaft 111 which is rotated through 180° at each typing cycle. At the beginning of the cycle, the shaft 111 begins to rotate anticlockwise together with three cams 119, 109 and 182.

By means of levers 112 and 117 and a bail 122, the cam 119 (FIG. 1) releases the code bars 42, which are arrested selectively by means of the teeth 157 according to which setting element 31 has been set. The position of the bars then controls, through a decoder known per se, the selection of the character to be typed corresponding to the depressed key.

Figure 3:
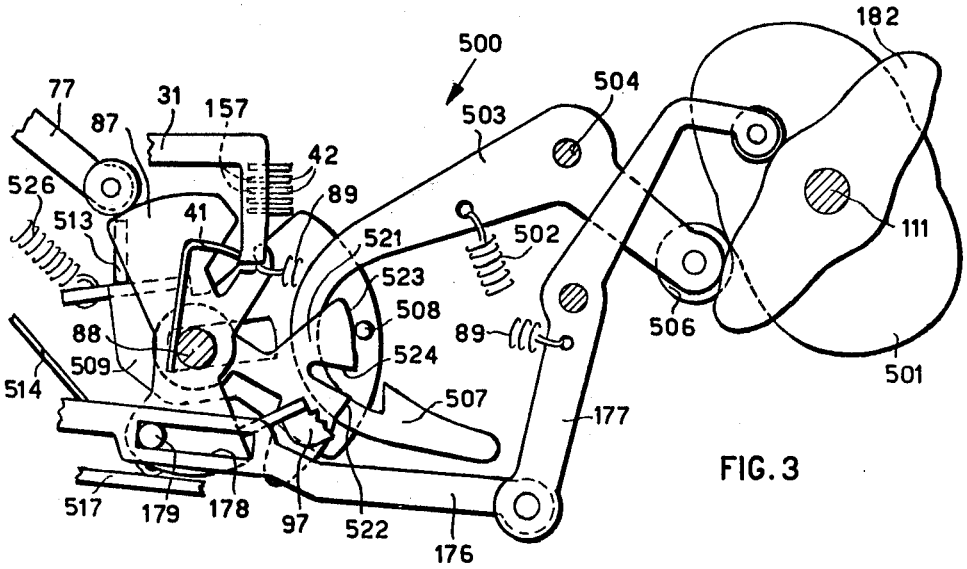
FIG. 3 is a partial longitudinal view of a number of details of FIG. 1 and FIG. 2 in one operative position.

The cam 109 causes the lever 97 to turn anticlockwise, removing it from the path of the cam 87, as shown in FIG. 3, in opposition to the action of the spring 96 (FIG. 1) and prearranges the stopping of the typing cycle after the shaft 111 has rotated through 180°.

The cam 182 (FIG. 3) causes a lever 177 to turn anticlockwise in opposition to the action of the spring 89, causing the tie rod 176 to slide back (to the right in FIG. 3). By means of the end of the slot 178 and the pin 179, the rod 176 causes the shaft 88 to rotate anticlockwise together with the universal bent plate 41 and the cam 87, bringing them back to rest or the inoperative position and loading the setting spring 89 at the same time, until the recocked position shown in FIG. 1 is reached.

Figure 4:
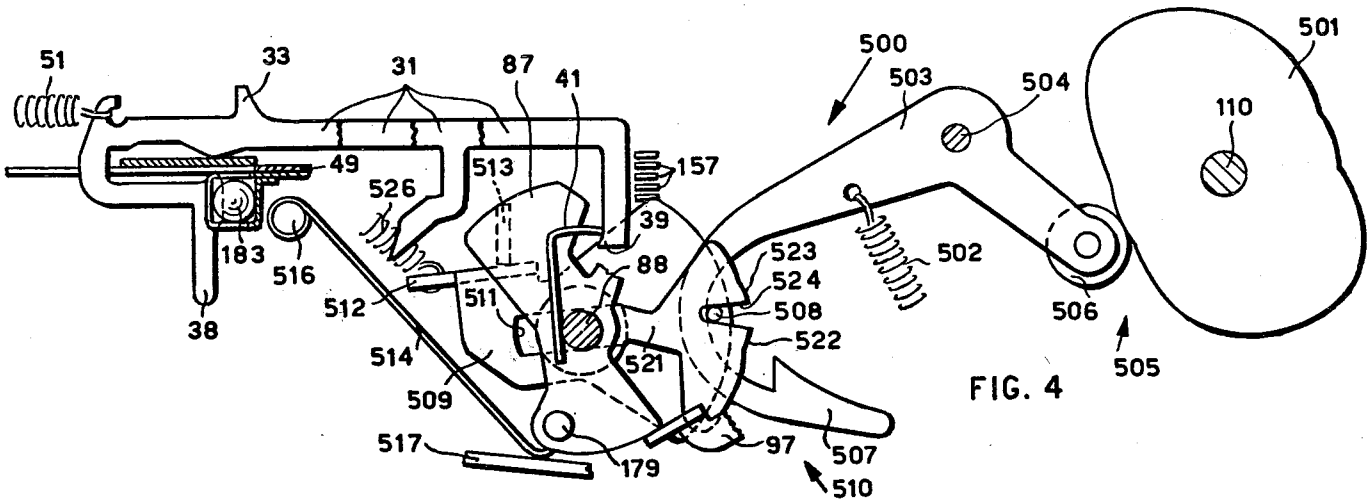
FIG. 4 is a partial longitudinal view of the details of FIG. 3 in a second operative position.

The mutual locking between the various keys 11 (FIG. 1) is ensured by balls 183 which, although not preventing the simultaneous depression of two or more keys 11, prevent two or more released setting elements 31 being set simultaneously in the path of the code bars 42. It is to be noted that, in order to obtain a quick-acting kinematic train, the various parts are relatively light and the spring 89 is so calculated that, when the universal bar 41 engages a plurality of setting elements 31 simultaneously, the spring 89 imparts to the bar 41 a speed substantially lower than that which it has when it sets a single setting element. When the balls 183 lock the setting elements 31, the universal bar 41 and the cam 87 moreover remain locked in a position of arrest, as shown in FIG. 4, which does not allow the cam 87 to release the lever 97 and therefore start the clutch 107 (FIG. 1). Under these conditions, the keyboard would remain locked.

The mechanism 500 for recocking the keyboard (FIG. 2) comprises a reloading mechanism 505 and a sensor 510 for the speed of the bar 41. The mechanism 505 comprises a reloading cam 501 fixed on the continuously rotating driving shaft 110 and a spring 502 which normally keeps a cam-following lever 503, pivoted on a spindle 504, bearing against the cam 501 by means of a roller 506.

The sensor 510 for the speed of the bar 41 comprises an inertial element constituted by a slide plate 509 and a guide 521 for this inertial element. The cam-following lever 503 is provided with a catch or hook 507 adapted to co-operate with a pin 508 on the slide 509 when the slowed-down speed of the bar 41 is detected. The slide 509 is slidable on the shaft 88 by means of a slot 511 and comprises a lug 512 adapted to co-operate with a fixed shoulder 513 and with a leaf spring 514 pivoted on a pin 516 and normally bearing against a fixed plate 517.

Figure 2:
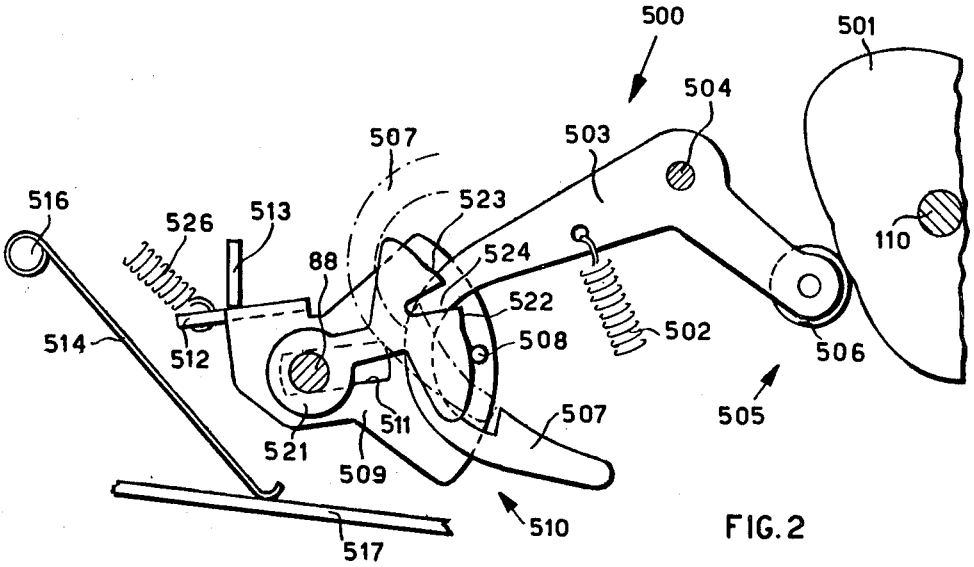
FIG. 2 is a partial longitudinal view of a recocking mechanism embodying the invention.

The guide 521 comprises a pallet 521 signalling the locking of the inertial element 509, fast with the shaft 88 and having a first cam surface 522 and a second cam surface 523 having an almost circular profile, the cam surfaces being separated by a radial notch 524 adapted to accommodate the pin 508. A spring 526 normally holds the slide 509 at rest, the slide being arrested with the pin 508 against the first cam surface 522 and with the lug 512 against the fixed shoulder 513, i.e. as shown in FIG. 2. Moreover, close to the edges of the notch 524, each of the cam surfaces 522 and 523 has a profile projecting a little with respect to the remaining parts which, on the contrary, have a profile of constant radius. The tension of the spring 526 on the slide 509 is low and therefore normally has an inconsiderable effect on the action of the setting spring 89 (FIG. 3) on the bar 41.

The automatic recocking mechanism operates in the following manner. On depression of a key 11 (FIG. 1), the setting spring 89 causes the universal bar 41, the cam 87 and the pallet 521 (FIG. 3) to rotate clockwise, moving the released setting element 31 towards the path of the teeth 157 of the code bars 42, as shown in FIG. 3. During this rotation, the projecting profile of the cam surface 522 shifts the slide 509 outwards radially in opposition to the action of the spring 526. With a single setting element 31 set, the force exerted by the setting spring 89 on the bar 41 imparts to the pallet 521 a speed such as to cause the pin 508 to leave the projecting profile. The action of the spring 526 on the mass of the slide 509, on the other hand, is rather limited. The slide 509 remains substantially still and the notch 524 passes in front of the pin 508, which is distant therefrom.

Moreover, the speed of the pallet 521 is such that the notch 524 does not move in time to engage the pin 508. When the spring 526 brings the slide 509 back towards the pallet 521, the pin 508 has already jumped the notch 524 and engages the profile of the second cam surface 523. The setting elements 31 having been set, the cam 87 is therefore temporarily arrested by the engagement of the pin 179 with the end of the slot 178.

Through the medium of the lever 177 and the tie rod 176, the cam 182 brings the cam 87 back to rest or the inoperative position together with the shaft 88 (FIG. 3) and the universal bar 41, reloading the spring 89 and imparting to the pallet 521 a speed such as to move the pin 508 away from the projecting profile of the cam 523. In this case also, the notch 524 is therefore not engaged by the pin 508. Instead, the pin re-engages the projecting profile of the first cam surface 522, thus jumping the notch 524. Finally, the lever 77 arrests the cam 87, bringing the keyboard back to the inoperative recocked state.

Independently of the movement of the bar 41, the reloading cam 501, rotating with the shaft 110 (FIG. 2), causes the cam-following lever 503 to oscillate continuously with the hook 507 between the positions indicated in FIG. 2 in solid lines and chain-dotted lines. The pin 508, engaged by the cam surfaces 522 and 523, always remains out of the path of the hook 507 and is therefore not influenced by the hook. In consequence, in a normal typing cycle, when a single key 11 (FIG. 1) is depressed and a single setting element 31 is set, the recocking mechanism 500 does not change the operation of the kinematic train.

Figure 5:
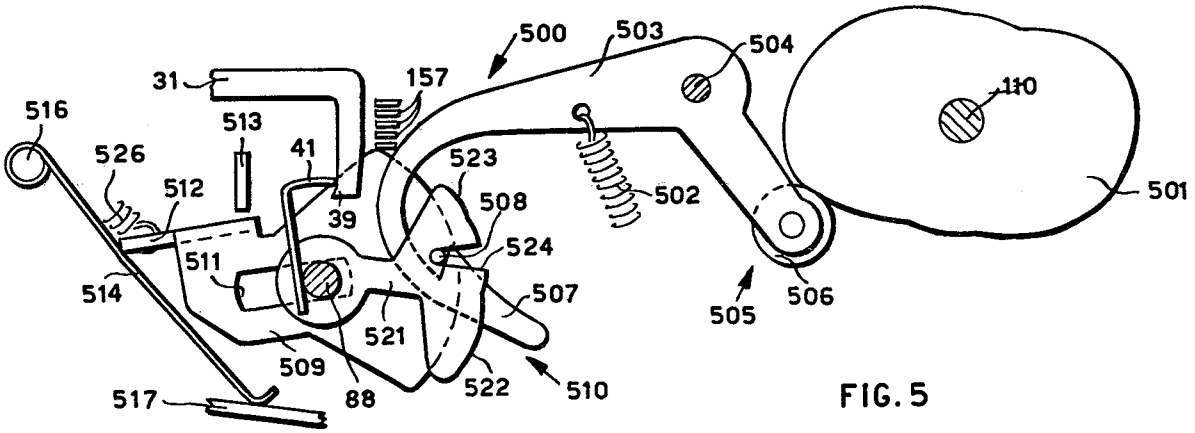
FIG. 5 is a partial longitudinal view of the details of FIG. 3 in a third operative position.

On the other hand, on depressing two or more keys 11 (FIG. 1) simultaneously, the bar 41 engages two or more setting elements 31. The force exerted by the setting spring 89 being constant, the bar 41 and, therefore, the pallet 521 (FIG. 4) move at a speed slowed down with respect to that corresponding to the setting of a single setting element 31. Under these conditions, in spite of the radial thrust of the first cam surface 522 on the pin 508, the spring 526 succeeds in keeping the pin 508 in contact with the projecting profile of the cam surface 522. The speed of the pallet 521 is now such that the notch 524 is engaged by the pin 508. Moreover, the balls 183 lock the two setting elements 31, thus also arresting the pallet 521 with the notch 524 disposed in front of the pin 508. The action of the spring 526 on the slide 509 causes, in turn, the introduction of the pin 508 into the notch 524, as shown in FIG. 4. The lever 97 does not succeed in engaging the steep part of the cam 87, but remains bearing against the cam and cannot activate the clutch 107 (FIG. 1), which remains open or disengaged, deactivating the typing kinematic train. When the continuously oscillating cam-following lever 503 is in the position of FIG. 4, the pin 508 housed in the notch 524, as a result of the action of the spring 526, bears against an inner edge of the lever adjacent the hook 507. The reloading cam 501, continuing to rotate with the driving shaft 110, then causes the cam-following lever 503 to turn clockwise in opposition to the action of the spring 502, bringing the hook 507 into engagement with the pin 508. The hook 507 therefore carries the pin 508 along anticlockwise as it rotates, together with the slide 509, the pallet 521, the shaft 88, the cam 87 and the universal bar 41, as shown in FIG. 5.

During this rotation, the lug 512 of the slide 509 engages the leaf spring 514 and bends it, thereby loading it.

After the reloading cam 501 has rotated through about 90°, the cam 87 (FIG. 1) and the universal bar 41 are brought back into the inoperative position shown in FIG. 1. Owing to the action of the spring 502 on the lever 503, the hook 507 now turns anticlockwise and the previously loaded leaf spring 514 (FIG. 5) causes the slide 509 to slide back rapidly (to the right in FIG. 5) on the shaft 88 by means of the slot 511, overcoming the action of the spring 526, until the pin 508 is disengaged from the hook 507. The lug 512 leaves the spring 514 and the spring 526 brings the slide 509 back to the inoperative state, arrested with the pin 508 against the first cam surface 522 and with the lug 512 against the fixed shoulder 513, as shown in FIG. 2. The setting elements 31 (FIG. 1) which have been set simultaneously are in turn brought back to the inoperative state or recocked position by the respective springs 51, as described in the abovementioned specification.

The keyboard is thus unlocked, with the various kinematic trains in the inoperative state or position, and is ready for a new typing cycle. The recocking mechanism 500 (FIG. 2) has thus unlocked the keyboard automatically and rapidly without the operator having had to actuate any part and without interrupting the continuity of the typing. The mechanism will act as described if two or three keys are depressed simultaneously.

To prevent actuation of the keys 11 (FIG. 1) when the keyboard is not functioning because the typewriter is switched off, the keyboard comprises an inverted V-element 187 disposed transversely of, and below, the setting elements 31. The inverted V-element 187 is fast and rotatable with a shaft 188 and has a length such as to co-operate simultaneously with tailpieces 38 of the setting elements 31. An on/off key 189 (FIG. 7), shown in the position in which the machine is switched on, has an end 191 adapted to co-operate with a lug 192 of a lever 193 fast with the shaft 188. The key 189 is provided with a tie rod 190 connected to activate the electric motor of the machine (not shown in the drawings) in a manner known per se and therefore set the driving shaft 110 in rotation. A spring 194 normally keeps the lever 193 turned anticlockwise and the inverted V-element 187 (FIG. 1) spaced from the tailpieces 38.

The lever 193 (FIG. 7) has a pin 531 housed in a slot 532 of a reloading bar 533 slidable on the shaft 88 by means of a slot 534. The bar 533 has a lug 536 adapted to co-operate with a pin 537 of a crank 538 fixed on the shaft 88. A spring 539 normally keeps the reloading bar 533 arrested with the end of the slot 532 against the pin 531 of the lever 193.

Figure 7:
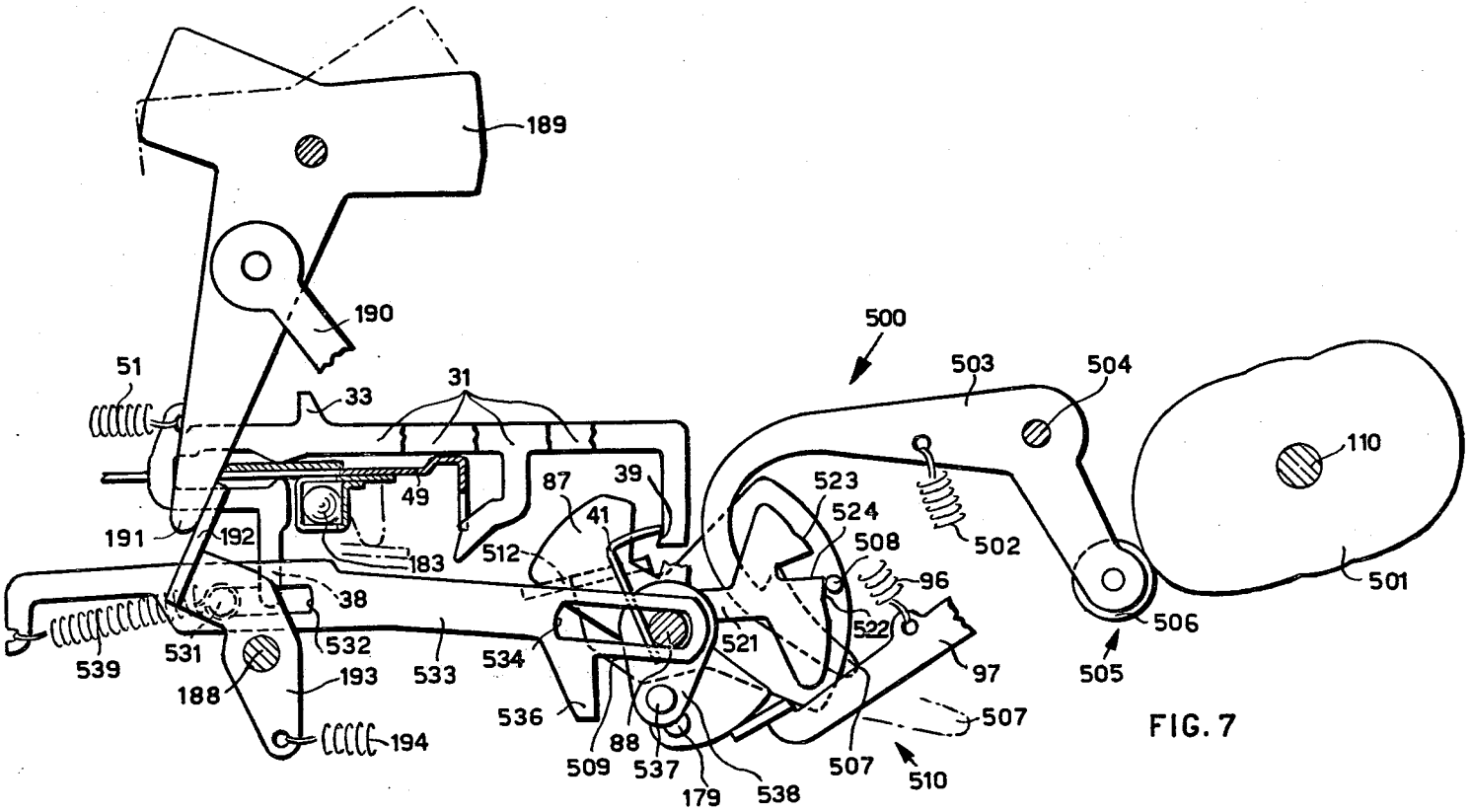
FIG. 7 is a partial longitudinal view of details of FIG. 6 in a particular operative position.

By turning the key 189 (FIG. 7) into the position in which the machine is switched off, as shown by a chain-dotted line in FIG. 7, the upper end of the inverted V-element 187 (FIG. 1) is arranged against the tailpieces 38, preventing actuation of the setting elements 31, and the reloading bar 533 is moved back (to the right in FIG. 7) so as to engage the pin 537 of the crank 538 by means of the lug 536. The tension of the spring 539 is much higher than the tension of the setting spring 89 (FIG. 1), so that rotation of the shaft 88 is also prevented in this way.

Very rarely, accidental depression of four or more keys 11 will occur and cause the simultaneous setting of the respective setting elements 31. The setting spring 89 also begins in this case to cause the shaft 88 to rotate, with the universal bar 41, the cam 87, the anchor member 521 (FIG. 7) and the crank 538. The universal bar 41 engages the four setting elements 31 and begins to pull time back (to the right in FIG. 7). Since the sum of the tensions of the respective springs 51 of the simultaneously set setting elements 31 is higher than the tension of the setting spring 89, the bar 41 is locked before the setting elements 31 engage the balls 183. In this way, a locked keyboard situation is produced in which the pin 508 of the mechanism 500 is still bearing against the first cam surface 522 of the pallet 521 and as shown in FIG. 7. Consequently, the lever 97 remains bearing against the high part of the cam 87 and the cycle is not started. The reloading cams 501 continues to cause the hook 507 to oscillate between the positions shown in FIG. 7 in complete lines and chain-dotted lines, but since the pin 508 is now bearing against the cam surface 522, out of the path of the hook 507, the hook itself cannot act on the pin and does not unlock the keyboard.

In this case, it is sufficient to arrange the key 189 in the position in which the machine is switched off. The lever 193 then turns clockwise together with the pin 531 and moves the reloading bar 533 back, to the right in FIG. 7, under the action of the spring 539. The bar 533 engages the pin 537 with the lug 536, causing the crank 538 to turn anticlockwise with the shaft 88, thus bringing the universal bar 41, the cam 87 and the pallet 521 back to the inoperative position and loading the setting spring 89 (FIG. 1). The four setting elements 31 are pulled forward, to the left in FIG. 1, by the respective springs 51 and, with the aid of the rotation of the inverted V-element 187, are brought back to the inoperative position. The keyboard is therefore unlocked, with the various kinematic trains in the inoperative position, and is ready for a new typing cycle.

It is pointed out that the pin 508 could be sensitive only to the speed of the bar 41. The balls 183 could be dispensed with without affecting the working principle of the device. In fact, in the case of the engagement of more than one setting element 31, the speed of the pallet 521 would be such as to cause the pin 508 to engage in the notch 524. In this case, it would be the fixed shoulder 513 that would arrest the bar 41 in the intermediate locking position, without changing the operation of the mechanism with respect to the manner previously described.

The reloading mechanism could be of any desired known type and not only the oscillating lever type described. For example, the sensor 510 could actuate a microswitch for activation of an electromagnetic unlocking mechanism or the control element of a corresponding unlocking clutch.

What I claim is:

1. A keyboard for a printing machine comprising a series of depressable keys; a series of intermediate members associated with said keys and each selectable by depression of one of said keys; a common actuator actuatable from an inoperative position to an operative position; spring means moving said common actuator to said operative position in response to moving of each of said keys, said common actuator engaging the selected intermediate member and moving said selected intermediate member to a predetermined speed; operative means associated to said intermediate members for performing a selected operation upon movement of said intermediate members; reloading means operative for returning said common actuator to said inoperative position for reloading said spring means upon performing of the selected operation; locking means for stopping the operation of said operative means and causing the return of said common actuator whereby blocking further operations of said operative means in the case when two keys are simultaneously depressed, said common actuator engaging said two selected intermediate members but being moved by said spring means at a speed substantially reduced with respect to said predetermined speed and unblocking means responsive to the reduced speed of said common actuator for returning said common actuator to said inoperative position, in the place of said reloading means whereby enabling the further performing of operations by said operating means.

2. In a keyboard of an electric typewriter, teleprinter, accounting machine and like machines comprising a series of depressable keys; a series of intermediate members associated with said keys and each one of said intermediate members being selectable by a corresponding one of said keys; a common actuator engageable with said selected one of said intermediate members; spring means operative on said common actuator for moving the selected one of said intermediate members at a predetermined speed to a set position and operative means responsive to the set position of said intermediate members for performing a selected operation corresponding to the key which has been depressed; the engagement of said common actuator with more than one intermediate member consequent upon simultaneous depression of more than one key causing said common actuator to move under said spring means bias at a substantially reduced speed with respect to said predetermined speed, the combination comprising:

a sensor responsive to the speed of said common actuator;

blocking means controlled by said sensor and arranged to block the movement of said common actuator and said operative means when said substantially reduced speed is sensed; and recocking means further responsive to said sensor to recock said common actuator and said intermediate members to recocked positions ready for initiation of other operations by depression of said keys.

3. A keyboard according to claim 2, wherein the sensor comprises an inertial element and a guide for said inertial element wherein said guide moves with said common actuator, wherein the guide inparts movement of the inertial element along a first path when the common actuator is moved at said predetermined speed and a second path when the common actuator is moved at substantially reduced speed, and wherein said recocking means comprise a recocking element cooperative with the inertial element to restore the common actuator and engaged intermediate members only when the inertial element follows the second path.

4. A keyboard according to claim 3, wherein the guide comprises a pallet movable with the common actuator and provided with a cam surface for guiding the inertial element in the first path and a notch substantially perpendicular to the cam surface for guiding the inertial element in the second path, the notch being jumped when the speed of the guide is not substantially reduced.

5. A keyboard according to claim 4, wherein the inertial element comprises a slide rotatable and slidable with respect to the common actuator and provided with a pin for cooperating with the cam surface and the notch and a spring member for urging the pin toward the cam surface and the notch so as to cause the notch to be jumped or engaged when the common actuator moves at the predetermined speed and the substantially reduced speed, respectively.

6. A keyboard according to claim 5, wherein the recocking means comprises a hook element cooperating with the sensor when the pin is positioned in the notch, causing the slide to rotate with the guide to bring the common actuator back to the recocked position.

7. A keyboard according to claim 6, further comprising a lug and a spring, wherein the slide is kept at rest, relative to the rotation, by the lug and, during the rotation for bringing the common actuator back to the recocked position, the lug loads the spring for acting on the slide when the common actuator is in the recocked position to disengage the pin from the hook element and permit the spring member to bring the slide back into its inoperative position.

8. A keyboard according to claim 2, wherein the sensor comprises an inertial element and a guide for said inertial element, wherein said guide moves with said common actuator, wherein the guide imparts movement of the inertial element along a first path when the common actuator is moved at said predetermined spead and a second path when the common actuator is moved at substantially reduced speed, and wherein said blocking means comprise means cooperative with the inertial element to block said common actuator when the inertial element follows the second path.

9. A keyboard according to claim 8, wherein said guide comprises a pallet movable with the common actuator including a cam surface and a notch substantially perpendicular to the cam surface, and said inertial element comprises a pin for cooperating with the cam surface and the notch of said pallet and a spring for urging the pin toward said cam surface and said notch so as to cause the notch to be engaged by said pin when the common actuator moves at said substantially reduced speed and wherein said means cooperative with the inertial element comprise a block element for avoiding the movement of said pin in accordance with the movement of said pallet in manner that said block element blocks the movement of said common actuator through said pin and said pallet when said notch is engaged by said pin.

10. In a keyboard for typewriters, teleprinters, calculating, accounting and like machines of the type comprising a series of depressable keys; a series of intermediate members movable from an inoperative position to a working position and each one of said intermediate members being selectable by a cooresponding one of said keys; a common actuator movable with the selected one of said intermediate members; a starting clutch; spring means moving said common actuator to a predetermined speed for actuating the starting clutch and the selected one of said intermediate member in the working position; a reloading element actuated by said starting clutch for bringing the common actuator back to a recocked position; and a locking mechanism for arresting the common actuator in a locking position insufficient for activation of the starting clutch in the case of engagement with two intermediate members consequent upon depression of more than one key, said spring means bias causing said common actuator to move at a substantially reduced speed with respect to said predetermined speed; the combination comprising:

an entraining element synchronous with the common actuator;

a sensor element responsive to the speed of said common actuator to be moved from an inoperative position at said predetermined speed of the common actuator to an operative position, when the common actuator moves at said substantially reduced speed, said sensor element engaging the entraining element, in the operative position thereof;

a recocking mechanism countinuously oscillating and engageable with said sensor element in said operative position to bring the common actuator back from the locking position to the recocked position through the medium of said sensing element engaged in the entraining element and independently of the reloading element.

11. A keyboard according to claim 10, wherein the sensor element comprises an inertial element and the entraining element is constituted by a guide for said inertial element having a notch, wherein said operative position is determined by the engagement of the inertial element in said notch wherein said locking mechanism comprises a blocking element for arresting the movement of said guide when said inertial element engages said notch and wherein the locking position of said common actuator is determined by the position of arrest of the guide effected by the blocking element on said notch.

12. A keyboard according to claim 11 wherein, in the locking position of the common actuator, the notch is in front of a pin, so as to allow the spring to engage the pin in the notch, independently of the value of the reduced speed.

13. A keyboard according to claim 11, wherein the guide comprises a pallet having a cam surface for guiding the inertial element adjacent to said notch and substantially perpendicular to said cam surface, wherein the inertial element has a pin for cooperating with the cam surface and the notch and a spring member urges the pin toward the cam surface and the notch, and wherein the recocking mechanism comprises a hook element cooperating with the pin when it is positioned in said notch.

* * * * *